United States Patent [19]

Bryant

[11] 4,074,141

[45] Feb. 14, 1978

[54] PREFABRICATED X-RADIATION PROTECTION PANELS

[76] Inventor: Frank E. Bryant, 28 Honeybear Lane, Romeoville, Ill. 60441

[21] Appl. No.: 679,836

[22] Filed: Apr. 23, 1976

[51] Int. Cl.[2] ..... G21F 3/04

[52] U.S. Cl. ..... 250/517; 52/284; 52/584

[58] Field of Search ..... 250/517; 52/489, 615, 52/285, 220, 584

[56] References Cited

U.S. PATENT DOCUMENTS

| | | | |
|---|---|---|---|
| Re. 18,349 | 2/1932 | Lapof | 250/517 |
| 3,299,270 | 1/1967 | D'Avella | 250/517 |
| 3,802,146 | 4/1974 | Tacke et al. | 52/489 X |
| 3,998,018 | 12/1976 | Hodges | 52/489 X |

*Primary Examiner*—Davis L. Willis

*Attorney, Agent, or Firm*—Emrich, Root, O'Keeffe & Lee

[57] ABSTRACT

Prefabricated self-supporting lead-lined wall panels for radiation protection of an enclosed space are disclosed. A unified rectangular frame of tubular channel members provides for the attachment of a lead sheet and an overlying shielded laminate on one side of the frame with the elongated slots or channels on the other side detachably supporting a trim panel. Both the channel openings and an exposed side of the frame provide points of attachment of the wall panels to existing structures or to another wall panel in edge-to-edge or perpendicular relationship. Also the channel openings of the frame provide conduit space for the installation of electrical wiring.

9 Claims, 11 Drawing Figures

110
10
104
A
78
160
162
130
166
160'
168
164
B
10a
44
30
88
154
70
78
86
90
80
150
152
32
134
132
24
186
24'
172
264
266
38
34
26
28
38a
52
76
262
22
54
50
46
20
40
43
42
36

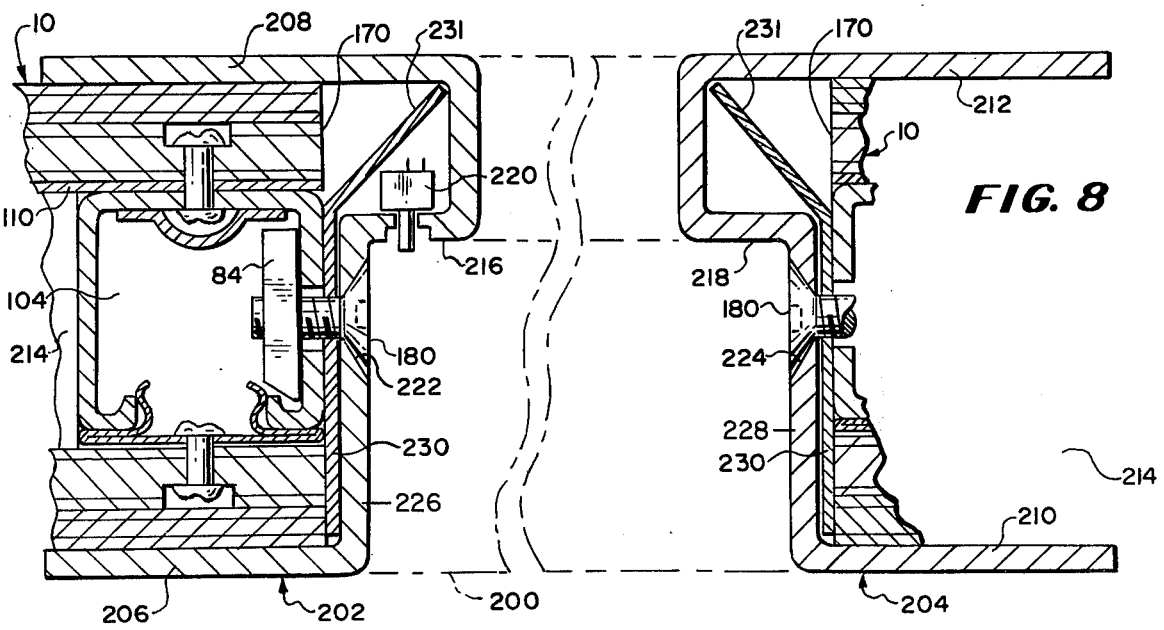
FIG. 8
FIG. 9
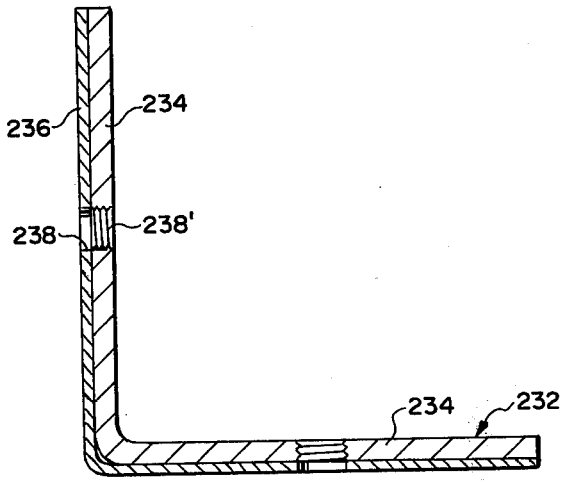
FIG. 10
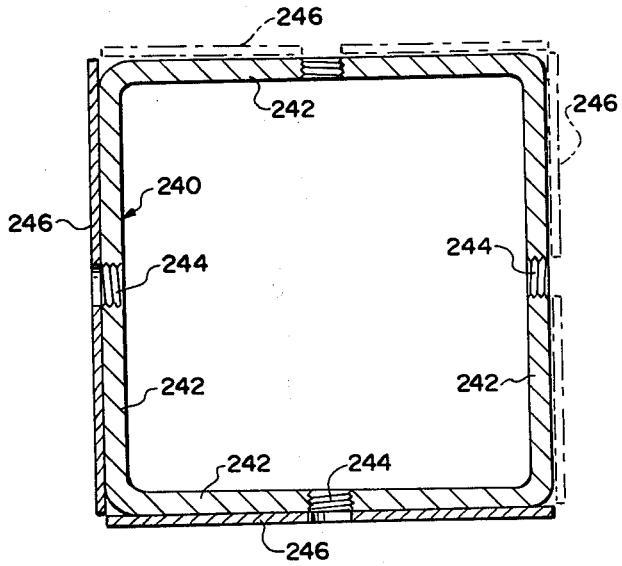
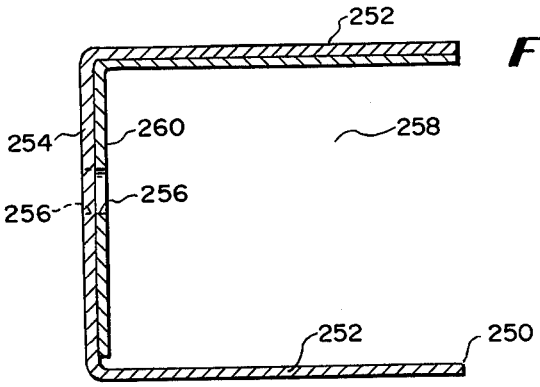
FIG. 11

PREFABRICATED X-RADIATION PROTECTION PANELS

BACKGROUND OF THE INVENTION

Various forms of shielded or lead-lined panels for room enclosures and also methods of applying sheets of lead to wall structures are shown in the prior art. The Laepof U.S. Pat. No. 1,815,922 discloses a lead-lined board which presents a finished surface on one side and attaches to both at abutting edges over a thin strip of lead to form a continuous sheath at all junctures. Barry U.S. Pat. No. 1,780,108 discloses a method for applying conventional leadlined panels or gypsum board to existing walls through wooden studs or furring strips so that there is an overlapping lead seal at the joints. In the Ferre U.S. Pat. No. 2,894,463 there is to be found a disclosure of lead encased or sheathed metal fasteners for installing lead-lined panels to existing wall surfaces. Shoenfeld, in his U.S. Pat. No. 3,134,020 shows lead paneling for booths characterized by the use of various forms of lead-lined fastening channels made of steel.

The structures disclosed in the Laepof and Barry patents no doubt function properly for their intended purposes but have a number of distinct disadvantages including the fact that their wall structures cannot be pre-fabricated in-toto, they require separate supporting structures and the form of construction makes it possible to salvage the materials for reuse or modification. Ferre provides a fixed, inflexible structure similar to Barry and Laepof, designed only for attachment to the studding of a wall. Shoenfeld makes no provision for integral electrical connections and his walls are not structurally designed to support auxiliary equipment, nor are there any choices as to the finished surfaces to be used therewith. Other prior art devices of this general nature show structurally unrelated shielding methods employing permanently installed lead-lined panels for existing wall or stud framing.

SUMMARY OF THE INVENTION

According to this invention the disadvantages of the prior art structures are overcome by providing a more versatile panel unit, the framed part of which can be installed in a variety of configurations and, after the installation of the required wiring and any auxillary equipment intended to be hidden in the panel, a finish panel is provided which snap-fits upon the open exposed side of the panel frame unit to complete the installation. Moreover, the detachable panel or panels can be subsequently removed, in the event changes or additions are required in the wiring system, and then readily re-installed without damage or the necessity for the use of fasteners.

In particular, each panel unit includes a generally rectangular metal frame formed of a plurality of channel members rigidly attached to each other as by welding. Each of the channel members comprises an elongated tubular element having a bight wall portion, a pair of opposing spaced side walls and an elongated open channel or slot in the fourth wall, opposite and spaced from the bight wall portion, defined between a pair of spaced, parallel inwardly directed flange edges.

The bight wall portions of the various channel members forming the frame present flat, co-planar attaching surfaces to receive an inner lead sheet and an outer cover or panel laminated and bonded thereto. This lead sheet and its outer cover panel are rigidly but detachably affixed to this one side of the frame to define the exterior part of the panel or wall and may include an outer finish laminate surface or coating of a decorative or fire-resistant nature.

The outer side walls of each tubular element of the frame of each panel unit of this invention are exposed along all four edges. These outer side walls have bore holes and knock-out plugs therein provide respectively attaching points and available apertures through which to thread electrical conduits, and the like. The inner of these side walls of each tubular frame element need only include knock-out plugs opposite to and axially alined with the knock-out plugs in the outer side walls so that wiring conduits can be passed through the sides or through the top or bottom of each panel unit. Alternately, the frame can include furring strips that extend along and adjacent to each of these inside walls with their outer and inner surfaces coplanar with the bight wall portions and the fourth or slotted wall portion of the frame elements.

The fourth wall portions of the various channel members forming the frame present flat, co-planar surfaces on each side of the channel openings for holding the detachable wall panel on the inside of the panel units of this invention. Each of the detachable panels has an elongated snap-on cleat or bracket member permanently affixed along each of the inside edges. The outer surfaces of the attachable panels can have a permanently bonded finish surface of decorative or fire-resistant qualities.

The snap-on cleats have spaced parallel, elongated outwardly directed flexible flanges which are adapted to engage between, snap-fit or mate, within the corresponding elongated channel or slot in the fourth wall of each tubular frame element. By these means the detachable panels can be readily installed over and upon the exposed frame portions of the panels to complete the wall panel units.

Also included as a part of the invention are lead-lined preformed transom units, a shielded door structure, leaded glass window and various lead-lined wall matching columns, closed corner columns and corner column connections which are used, respectively, to attach panel units to existing walls, to connect two, thre or four panel units at a juncture or to form right or left hand corner connections. Provision is also made for the mounting of angle brackets at any selected positions along the channel openings in the frame for the purpose of attachment of the panel units to floors, walls or ceilings to suit construction conditions. Suitable cross bracing of channel members with furring strips on their sides may also be employed.

The panels of the instant invention are expandable in all dimensions to meet the individual requirements of specific installations. The panels may be entirely self-supporting or attached to existing building structures at the floor, ceiling, or walls, thus providing maximum mechanical strength with minimum loss of floor space at the time of installation.

An advantage of the C-shaped steel frame or channel members and the removable snap-on inside panels is that they provide access to any part of the panel from one side for pre-wiring therein of switches, receptacles and the like. These steel frame members are approved for use as electrical conduits in accordance with established practice.

Another advantage of the invention is that the entire panel assembly is one hundred per cent salvageable. Also, the lead shielding protection may be increased at a future date if requirements so change. Minimum field installation time is required to install the panels of this invention.

DESCRIPTION OF THE DRAWINGS

Illustrative embodiments of the invention are shown in the accompanying drawings wherein:

FIG. 8 is a horizontal sectional view taken across the doorway along line 8—8 of FIG. 1, and showing the structure of the door frames therefor.

FIG. 9 is a horizontal sectional view of an L-beam used for right or left hand corner connections.

FIG. 10 is a horizontal sectional view of a corner column to connect two, three or four walls in abutting relationship; and FIG. 11 is a horizontal sectional view of a wall mounting channel to attach a panel to an existing wall.

DESCRIPTION OF THE PREFERRED EMBODIMENTS

Figure 1:
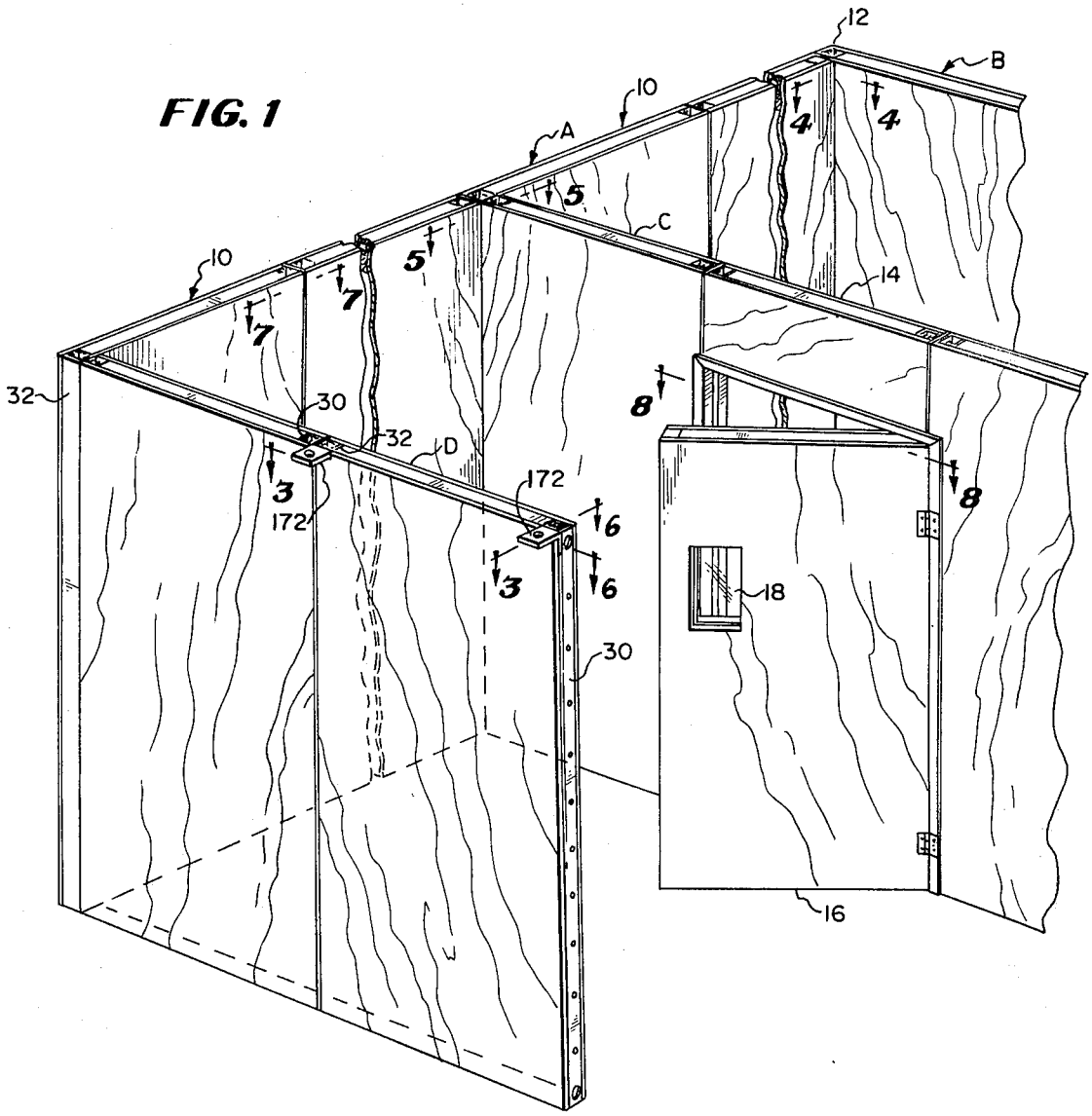
FIG. 1 is a partially-fragmented perspective view of an assembly of several panel units of this invention to illustrate the formation of adjoining rooms with a dividing wall and door.

Referring to the drawings, particularly FIG. 1, a room assembly is shown which may be self-standing or contained within and supported by an existing room or similar structure.

The room assembly includes a number of panel units 10 assembled in edge-to-edge relationship to form the elongated side walls A and B jointed to form a right angled corner 12, and assembled in edge-to-edge relationship to form a partiton wall C having a transom member 14 and the door 16 which, if desired, may be provided with a leaded glass window 18. Leaded glass windows may also be provided in any of the panel units. A single panel unit 10 may also be assembled with the wall A to form the partial partition D. Additional panels 10 to complete a four-sided enclosure, not shown, are intended to be included.

Figures 2, 4:
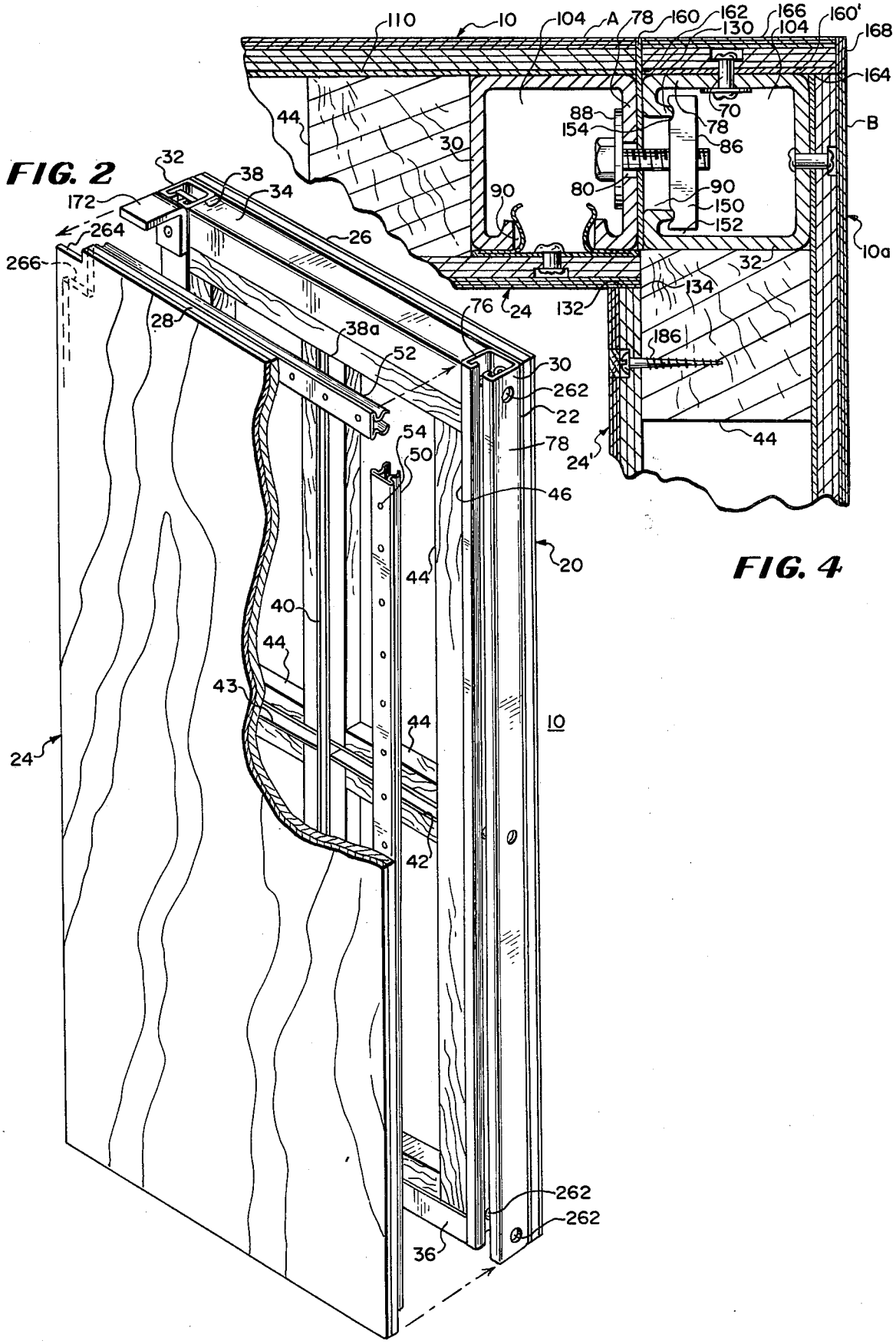
FIG. 2 is a partially-fragmented and exploded perspective view of one of the panel units of this invention.
FIG. 4 is a horizontal sectional view showing a corner construction and taken along line 4—4 of FIG. 1.

Referring to FIG. 2, a panel unit 10 is shown to comprise a unitized back or outer panel 20, shown with its welded metal frame 22 exposed on the inner side thereof and the removable inner trim panel 24, in this instance positioned as it may appear during the installation or upon its removal, for purposes of maintenance, installation of electrical wiring or change of the decorative appearane of that portion of a wall.

Still referring to FIG. 2, each panel unit 10 has an outer laminate structure 26 as part of the outer panel frame combination while the inner panel 24 has an inner laminate structure 28. These various parts and their individual components will be separately described in detail as the specification proceeds.

First, the metal frame 22 has the outer spaced parallel and identical channel members 30 and 32 on each its sides which extend from top to bottom and define the height and width of the frame. Shorter, but otherwise identical, top and bottom cross-channel members 34 and 36 are welded to the side channels, as at weldments 38 to define the width of the frame 22. A single vertical channel member 40 is joined centrally under the top channel 34 at weldment **38*a* and extends to a corresponding juncture (not illustrated) with the bottom channel member 36**.

A pair of identical, shorter, intermediate cross-bracing channels 42 and 43 is likewise affixed to each side of the single vertical channel member 40, at about the mid-point, each of which has its other appropriately affixed to the respective side channel members 30 and 32 as by welding.

FIG. 2 also reveals that a framework of furring strips 44 is provided on the inside wall of each channel member of the metal frame 22 and is affixed thereto by cementing the junctures 46. The arrangement of the furring strips 44 as well as the mode of their attachment at the junctures 46 is a matter of choice and this wooden framework can be omitted if desired.

The outer and inner laminate structures 26 and 28 are formed of one or more plywood layers or the like and can include an outer finish trim layer or veneer of chosen decorative design, as will be described.

The inner trim panel 24 has the same rectangular configuration and dimensions as the back panel 20 and has the side snap-on channels 50 (only one shown in FIG. 2) and top and bottom snap-on channels 52 (only one shown in FIG. 2) affixed thereto along the peripheral edges so as to be exactly opposite the respective metal side channel 30 and 32 and the top and bottom channels 34 and 36 of the frame 22. These snap-on channels have a series of spaced holes 54 therealong for purposes to be described.

Figure 3:
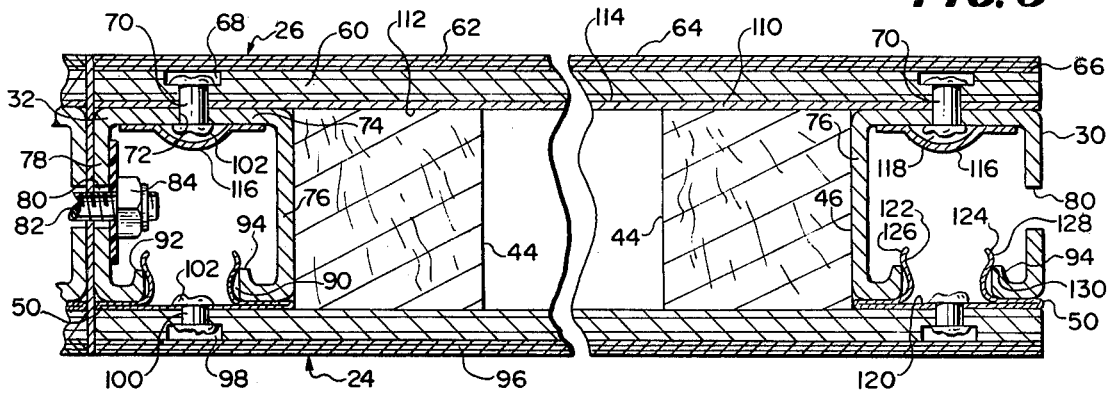
FIG. 3 is a horizontal sectional view of one of the panels taken along line 3—3 of FIG. 1.

FIG. 3 is a cross-sectional view taken along the lines 3—3 of FIG. 1 to show more of the details of the construction of a panel unit 10. Here the outer laminate structure 26 is shown to include an inner plywood layer 60 and an outer plywood layer 62 having a veneer trim surface 64. These layers are bonded at their juncture 66 with a suitable adhesive such as a contact panel adhesive, and may be reinforced with lead-headed or plain headed nails or screws.

The inner plywood layer 60 has suitably placed counter-sunk bore holes 68 to receive the pop rivets 70 (see FIG. 4) for attachment of the layer 60 to the welded frame 22 through the matching bore holes 72.

Each of the metal side channel members 30 and 32 is shown by the cross-section of FIG. 3 to include a bight wall portion 74, an inner wall portion 76 and an outer wall portion 78. The outer wall portion 78 has side bore holes 80 at the top and bottom and suitably spaced from the ends of the side channels to receive the fastening bolts 82 adapted to be used with either a hex nut 84 (FIG. 3) or a special lock nut 86 (FIG. 4) with a washer 88 therewith.

It is seen that the fourth wall of the channels 30 and 32 defines an elongated channel opening 90 along the entire length of the channels bordered by the inwardly directed spaced parallel flanges 92 and 94.

The inner laminate structure 28, which can include the trim veneer layer 96, has a series of suitably spaced counter-sunk holes 98 to receive the fastening rivets 100 which engage the holes 54 in the snap-on channels 50 and 52 (See FIG. 2). In FIG. 3 only the side snap-on channels 50 are shown. The fasteners 70 and 100 are identical and include a head end which fits in the counter bore and a peened end 102 which is generally within the opening 104 defined by the sides of the channel frame members 30 and 32.

As shown in FIGS. 3 and 4, the furring strips 44 abut the inside walls 76 of the channel members which juncture is about the glue point 46 and also abut the lead sheet 110 at the glue joint 112. The lead sheath 110 is a continuous planar piece of lead about 1.5mm to 3.0mm thickness, depending on the shielding requirements for the installation, and extends over the entire panel surface. The lead sheet 110 can also be glued to the inner plywood layer 60 or at the juncture 114. The rivets 70 pass through suitable holes in the lead sheet 110 and have their peened ends 102 covered by a preformed lead washer 116 and held by the adhesive cement layer 118.

A feature of the invention is the removability of the inner trim panel 24 from the outer trim panel 26. For this purpose the snap-on channels 50 and 52 are constructed of resilient steel, or the equivalent, and have a flat base portion 120 with a pair of inwardly bent, upstanding, spaced elongated and parallel disposed spring-like S-shaped flanges 122 and 124 each having an outwardly curved shoulder 126 and 128 that engages over the points 130 of the flanges 92 and 94 which define the channel opening 90. The channels 50 snap-fit into the channel opening 90 with considerable force so that a rigid but removable union is formed. The top snap-on channels 52 have the same structure and fit in the same manner into the top channels 34 of the frame 22. Also, the bottom channels 36 receive a corresponding bottom snap-on channel 52 (not shown) in the same mamnner.

FIG. 4 illustrates the manner in which a pair of panels 10 and 10*a* is attached to form a 90° corner 12 (FIG. 1) at the juncture of the walls A and B. Keeping in mind the fact that the openings 104 in the side channels 30 and 32 are accessible from the top and that the bore holes 80 in each of the outer side walls 78 are near each end or corner juncture of the top and bottom channels 34 and 36, it is apparent that the bolts 82 can be inserted through these bore holes to engage a special lock nut 86 held within the opening 104 of an opposing panel at right angles thereto. To accomplish this juncture the panel 10*a* was modified by providing it with a snap-on inside panel 24' having the edge 132 foreshortened to expose the channel opening 90 at its side channel 32 and form a corner 134 to receive the edge of the inner panel 24 of the panel unit 10. If desired, this edge can be fastened to the furring strip 44 by means of the wood screw 186.

The special lock nuts 86 each has a square head 150 which fits closely within opening 104 ad indicated by the spacing 152 so that they will not turn when the bolt is tightened. Additional holding force is provided by the pair of parallel spaced slots 154 in one face of the special lock nuts 86 which engage upon an over the points 130 of the walls 94 of the channels 32.

In order to insure that all junctures provide a lead barrier against radiation, the lead strip 160 is provided from top to bottom between the channel members. Also, an end lead strip 160' of the same dimensions is provided over the outer wall 78 of the channel 32 which joins or otherwise is contacted against the surface of the strip 160, as at 162 and against the edge of the corresponding lead sheet 110 of the second panel unit 10, as at 164. A finish batten strip 166 carrying the added lead strip 160' by means of the rivets 70 is also provided to finish the corner and, if desired, a smaller finish batten strip 168 is suitably attached at the offset corner of the assembly. The lead strips 160 and 160' can be essentially identical in dimensions. The panel 10*a*, so altered, can be used for a right-hand or left hand exposed corner 12 as seen from the illustration in FIG. 4.

Figure 6:
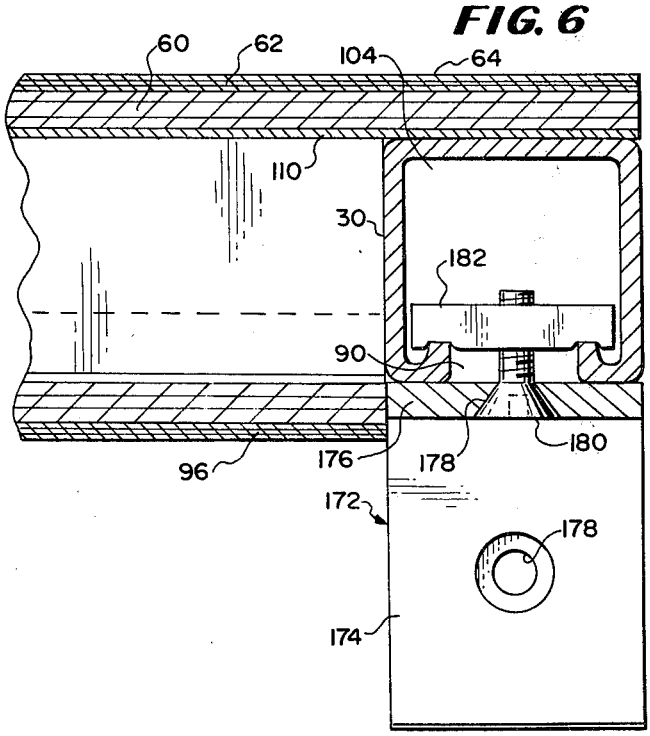
FIG. 6 is a horizontal sectional view at the end of a wall panel showing an auxillary attachment therefor and taken along line 6—6 of FIG. 1.

FIG. 6 is a cross-sectional view taken along the lines 6—6 of FIG. 1 to show the use of formed steel angle member 172 having a base plate 174 and an upright flange member 176 each with corresponding counter-sunk holes 178 to receive, in the former instance, a wood screw or suitable bolt or other fastener to fasten the panel unit 10 to the floor and in the latter instance to receive the flat head screw 180 that attaches to a tapped nut 182 which can be the same as the tapped nut 86 in FIG. 4. Preferably, the nut 182 is of thicker construction. Since the channel opening 90 extends the length of the channel frame member 30, the bracket or angle menber 172 can be attached at any selected position therealong. Again, since corresponding parts have already been identified, no further description is necessary.

Figure 7:
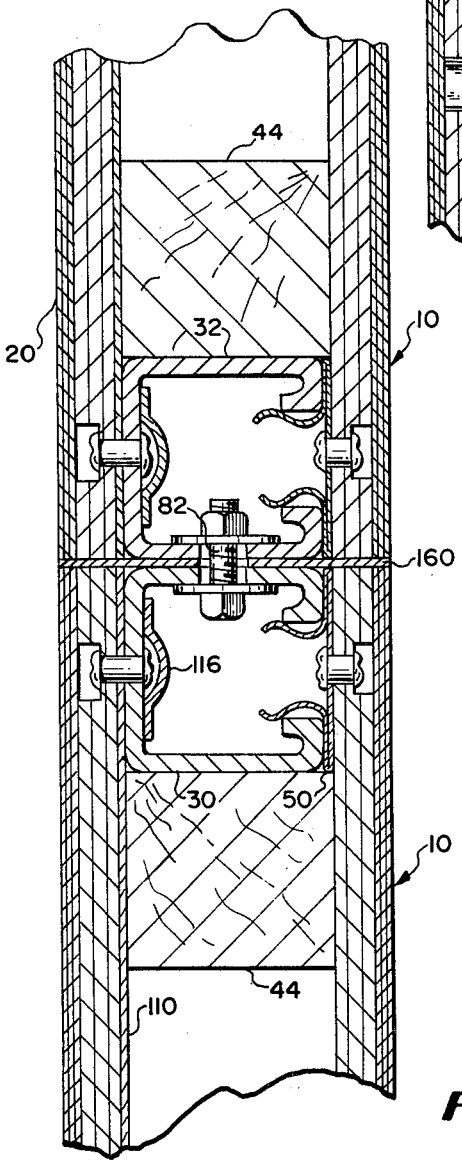
FIG. 7 is a horizontal sectional view taken along line 7—7 of FIG. 1, and showing the abutting structure of wall panels in the same plane.

FIG. 7 is an exploded view of a pair of panel units 10 in position to be assembled with their respective square side edges in abutting relationship upon the continuous lead joint seal strip 160. The parts shown are correspondingly numbered with those of FIG. 4 so that no detailed explanation is necessary.

Figure 5:
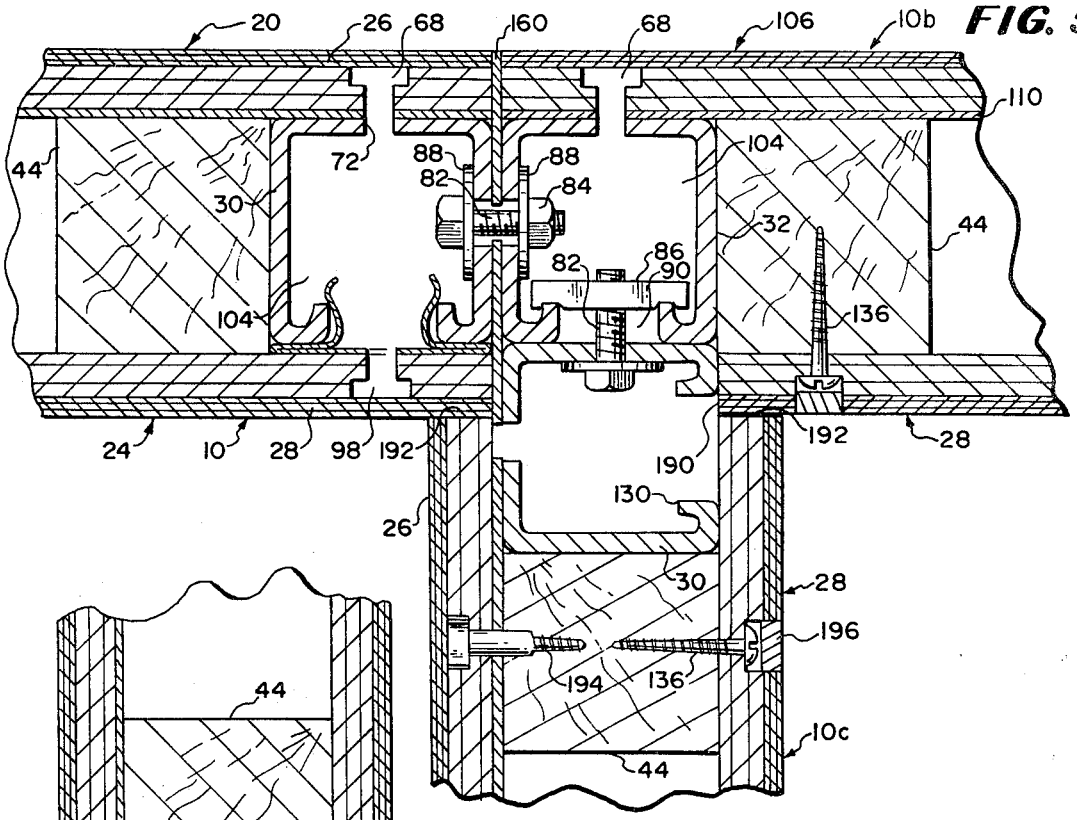
FIG. 5 is a horizontal sectional view taken along the line 5—5 of FIG. 1 and showing the abutment of one wall at the juncture of two other walls.

In FIG. 5 a "T" connection for two walls is shown wherein a panel unit 10 abutts a modified panel unit 10*b* and is joined by a second modified panel unit 10*c* joined at right angles to the panel unit 10*b*. In this embodiment, the channel 30 of the panel unit 10 is held to the edge of the modified panel unit 10*b* by means of a bolt 82 and a Nyloc nut 84, with a pair of washers 88 and a lead strip 160 therebetween.

The panel unit 10*b* is modified by foreshortening the edge 190 of the inside trim panel or laminate 28 to expose the channel opening 90 of the channel 32 of the frame thereof. Also, the panel unit 10*c* has been modified by foreshortening the edges 192 of its outer and trim panels 26 and 28 so that these two panels 10*b* and 10*c* overlap as indicated.

A second bolt 82 and interlocking nut 86 engages between the channel 32 of the panel unit 10*b* and the channel 30 of the panel unit 10*c* in the manner disclosed in FIG. 4. If deemed necessary, auxiliary wood screws 136 can be used along these cut-off edges to hold the trim panels 28 to the furring strips 44 as indicated. The fasteners 82 - 84 and 82 - 86 would also be used at the bottom of this "T" connection.

Since the lead-lined outer panel 26 is no longer attached by a pop rivet at the hole 80 in the channel 30 of the panel unit 10*c*, auxiliary lead nails 194 are used along this edge in proper spacing. Any exposed drill holes are covered with appropriate plugs as indicated at 196.

FIG. 8 shows the frame-work for the lead-lined door 16 which closes into the opening 200. The door frame comprises a pair of elongated channels 202 and 204 having spaced flanges 206, 208 and 210, 212 respectively, so as to define an opening 214 on each side of the doorway to receive the side edge 170 of a panel unit 10 therein. The channels 202 and 204 are of the same configuration and dimensions each being off-set to define its respective door jamb 216 and 218 against which the door 16 (not shown) closes. The jamb 216 against which the swinging or un-hinged edge of the door closes, is provided with an X-ray safety switch 220 which is normally open and is closed only when the door 16 is in its closed position. The switch 220 can be connected to the power source for the X-ray equipment or to a safety light as desired.

The pair of screws 180 engage through the countersunk holes 222 and 224 in the side walls 226 and 228 of the door frame channels 202 and 204, with their shanks passing through suitable apertures in the lead sheets 230 to engage the fastener nuts 84 in the side channels 30 or 32 of the adjacent panel units 10 (partially illustrated). The lead sheets 230 have the off-set or angular portions 231 positioned within the space defined by the jambs 216 and 218 to insure that a complete and continuous lead shield is provided across the doorway.

FIGS. 9, 10 and 11 show the cross-sectional configurations of a corner column connector, a closed column connection, and a channel member respectively, used for attaching panels to existing walls. In FIG. 9 the corner connector 232 comprises an elongated angle iron having the identical sides 234 that are as wide as the thickness of a panel unit 10. The outside surface carries the L-shaped lead sheet 236 thereon, and the sides have bore holes 238 which extend through the lead sheet 236 to receive the fastening bolts 82. The corresponding bore holes 238' in the sides 234 can be tapped to receive suitable metal screws.

The embodiment of FIG. 10 is a closed corner column 240 having the equal length side walls 242, each containing a bore hole 244 for this same purpose. Here, however, each side 242 is provided with a separate lead shim 246, with matching holes opposite the bore holes 244, that extends along the outer surface and against which a wall panel unit 10 is fastened in the manner already described. Two of these lead shims 246 are shown in dotted lines indicating that a total of four panel units 10 can be so attached in shielded relationship to the column 240.

The closed corner column 240 is used where 2, 3 or 4 walls come together at a common point. The lead shims 246 are used only when a wall panel is to be attached to one of the bore holes 244. In both FIGS. 9 and 10, the bore holes 238 and 244 are positioned at the tops and bottoms of the columns. The lead shims 246 and the lead sheet 236 can be cemented to the respective columns.

FIG. 11 illustrates still another form of wall mounting channel 250 which is U-shaped in cross-section and used to attach panel units 10 to existing walls of a room or similar structure. The channel 250 is of course elongated and has the side walls 252 and the connecting bight wall 254 having the bore hole 256 central thereof at the top and bottom. The side walls 252 define the open-sided channel 258 to receive the edge 170 of a panel unit 10 (not shown) and a lead shield 260 is provided, of L-shaped cross-section, against the inside surfaces of one side wall 252 and the bight wall 254. A matching bore hole in one leg of the lead shield provides access for a mounting bolt 82, a screw 180, as desired to engage the channel 30 or 32 of the panel unit 10 to be mounted thereby. The cleats 172 (See FIG. 6) can be used at the top and bottom of channel 250 to hold this assembly to the floor and ceiling of a room.

A number of modifications can be made in the structures so far described. Thus referring to FIG. 2 a series of opposed and aligned knock-out plates 262 can be provided in the opposite walls 76 and 78 of the channels 30 and 32 of the frame 22 of sufficient size to allow the entry of electrical conduit at selected positions therealong. In those instances where it is mechanically practical the lead shielding requirements can be increased to accomodate changes in equipment, location and duty cycles by providing a lead shield 110 in both panels 24 and 26. Alternately the inside panel 24 can be lead shielded while the outer panel 26 is without a lead shield. The frame and panel structure of the door 16 can advantageously incorporate the same configurations that have been described in relation to the panel units 10.

If desired, channel sections, like the channels 50 and 52 can be provided on the inside of the removable panel 24 opposite and for snap-fit engagement with the corresponding frame channels 40 and 43 of the outside panel 20 in order to increase the rigidity of the structure. Obviously the brackets 172 are only used where there is a permanent adjacent structure, floor or ceiling etc. to which attachment can be made. Their proper placement requires the cutting of off-sets such as 264 and 266 (FIG. 2) in the plywood panel layers 96 making up the laminate structure 28. Some of the fastening rivets have been omitted in the drawings to simplify the illustrations.

Changes may be made in the form, construction and arrangement of parts from those disclosed herein without in any way departing from the spirit of the invention or sacrificing any of the attendant advantages thereof, provided, however, that such changes fall within the scope of the claims appended hereto.

I claim:

1. A shielded wall panel assembly comprising:

a rectangular frame including a pair of vertical side channel members and a pair of horizontal top and bottom channel members secured together with their bight portions facing toward one side and with their open sides defining an elongated slot facing toward the other side;

an outside finish panel with an inner lead sheath secured to the bight portions of said channel members;

an inside finish panel having a snap-on fastening member extending along and contiguous to each of the edges of the inner side thereof;

said fastening members each defining a pair of spaced flanges adapted to snap-fit within the respective open sides of said channel members;

the outer legs of said channel members on opposite sides of said frame being substantially contiguous to the edges of said panels; and means for securing said outer legs of said channel members to an adjacent structure.

2. A shielded wall panel in accordance with claim 1 wherein:

the outer legs of said vertical side channel members of said frame have apertures adjacent the ends thereof to receive detachable bolt fastening means;

an elongated flat strip of lead shielding is provided having apertures adjacent its ends corresponding to said apertures in the outer legs of said vertical side channel members whereby one shielded panel is joinable through said fastening means to the outer leg of the vertical side channel member of an adjacent shielded panel with said elongated flat strip of lead shielding along the juncture.

3. A shielded wall panel in accordance with claim 1 wherein:

each of said horizontal top and bottom channel members abut with the inside top ends of said vertical side channels; and the outer and inner legs of said vertical side channel members include knock-out plugs of sufficient size to admit an electrical conduit to the space between said outside finish panel and said inside finish panel as defined by the depth of said channel members.

4. A shielded wall panel in accordance with claim 1 including in combination therewith:

a wall matching column adapted to attach said shielded wall panel to an existing structure, said wall matching column being a channel having a bight portion and a pair of integral side walls defining a side opening;

apertures for fastening means in said bight portion of said channel;

a continuous lead sheath secured on the inside surface of one of said side walls and the side of said bight portion with apertures therethrough corresponding to the apertures in said bight portion;

the span between the inside surface of said sheath on said one side wall of said channel and the inside surface of the other side wall of said channel being sufficient to receive and laterally support a shielded wall panel edgewise therein; and with the fastening apertures in the outer leg of said frame member of said shielded wall panel corresponding to the fastening apertures in said bight portion of said wall matching channel.

5. A shielded wall panel in accordance with claim 1, including in combination therewith:

a corner connection column adapted to attach said shielded wall panel to a second shielded wall panel to form a right angle corner;

said corner connection column comprising an L-beam with a continuous lead sheath on the outer surfaces of each of its walls; and including apertures for fastening means that extend through said walls and said lead sheath, said apertures corresponding to the fastening apertures in said outer leg of said frame member of said shielded wall panel.

6. A shielded wall panel in accordance with claim 1, including in combination therewith:

a closed corner connection column of square configuration and adapted to connect a shielded wall panel along each of its four outer walls;

each of said walls having apertures for fastening means at the ends thereof corresponding to the apertures in the outer legs of the vertical side channel members of the frame of a shielded wall panel; and a lead shielding strip is provided along and for use with each of said four outer walls of said column and having apertures therethrough corresponding to the fastening apertures of said four outer walls, whereby at least a pair of shielded wall panels is connectable in abutting relationship with the sides of said column.

7. A shielded wall panel in accordance with claim 1 including in combination:

an L-shaped cleat member having an aperture in each of its walls;

a tapped nut and screw therefore received in either of said apertures interchangeably;

said tapped nut having a pair of opposite sidewalls that engage in non-turning slideable spaced relationship between the inside surfaces of the outer legs of said vertical sides of the channel members of said frame; and one other surface of said tapped nut having a pair of grooves spanning and engaging the flanges defining the channel openings thereof.

8. A shielded wall panel in accordance with claim 1, including in combination therewith:

a corner connection column adapted to attach said shielded wall panel to up to three other wall panels to form a closed corner;

said corner connection column comprising a box beam with a continuous lead sheath on each of its outer walls to which a wall panel attaches; and including apertures for fastening means that extend through said walls and said lead sheath, said apertures corresponding to the fastening apertures in the outer legs of the frame members of each of said wall panels.

9. A shielded wall panel in accordance with claim 1 including in combination therewith:

a wall-connecting column adapted to attach said shielded wall panel to an existing wall structure;

said wall connecting column comprising a beam of U-shaped cross-section, the legs of which define an opening to receive an L-shaped lead shim along two sides thereof;

the space between one of said lead shim sides and the opposite side of said column being sufficient to encompass and receive the edge of said shielded wall panel; and said column including apertures in its bight side and through the other of said lead shim sides corresponding to the fastening aperture in the outer legs of the frame members of said wall panel.

* * * * *

UNITED STATES PATENT OFFICE

CERTIFICATE OF CORRECTION

Patent No. 4,074,141 Dated Feb. 14, 1978

Inventor(s) Frank E. Bryant

It is certified that error appears in the above-identified patent and that said Letters Patent are hereby corrected as shown below:

Col. 2, line 35, after "elongated" insert --open--;

Col. 2, line 45, "thre" should be --three--;

Col. 4, line 6, after "each" insert --of--;

Col. 5, line 59, "ad" should be --as--; and

Col. 5, line 63, "an" should be --and--.

Signed and Sealed this

*Twenty-third* Day of *May 1978*

[SEAL]

*Attest:*

RUTH C. MASON
*Attesting Officer*

LUTRELLE F. PARKER
*Acting Commissioner of Patents and Trademarks*